US009280899B2

(12) United States Patent
Biess et al.

(10) Patent No.: US 9,280,899 B2
(45) Date of Patent: Mar. 8, 2016

(54) DYNAMIC SAFETY SHIELDS FOR SITUATION ASSESSMENT AND DECISION MAKING IN COLLISION AVOIDANCE TASKS

(71) Applicant: GM GLOBAL TECHNOLOGY OPERATIONS LLC, Detroit, MI (US)

(72) Inventors: Armin Biess, Ness-Ziona (IL); Ido Zelman, Ra'anana (IL); Mario Jodorkovsky, Nesher (IL)

(73) Assignee: GM Global Technology Operations LLC, Detroit, MI (US)

( * ) Notice: Subject to any disclaimer, the term of this patent is extended or adjusted under 35 U.S.C. 154(b) by 184 days.

(21) Appl. No.: 13/960,667

(22) Filed: Aug. 6, 2013

(65) Prior Publication Data

US 2015/0046078 A1 Feb. 12, 2015

(51) Int. Cl.
*G08G 1/16* (2006.01)

(52) U.S. Cl.
CPC ..... *G08G 1/166* (2013.01); *G08G 1/163* (2013.01)

(58) Field of Classification Search
None
See application file for complete search history.

(56) References Cited

U.S. PATENT DOCUMENTS 5,572,428 A 11/1996 Ishida
6,393,362 B1 5/2002 Burns
6,944,543 B2 9/2005 Prakah-Asante
8,615,357 B2 12/2013 Simon
2006/0293856 A1* 12/2006 Foessel et al. ..... 701/301
2009/0037088 A1* 2/2009 Taguchi ..... 701/117

FOREIGN PATENT DOCUMENTS

DE 103 26 358 A1 12/2004
DE 103 59 413 A1 7/2005

* cited by examiner

*Primary Examiner* — John R Olszewski
*Assistant Examiner* — Gerrad A Foster
(74) *Attorney, Agent, or Firm* — John A. Miller; Miller IP Group, PLC

(57) ABSTRACT

A system and method provided on an ego-vehicle for assessing potential threats in a vehicle collision avoidance system, and/or to plan safety-allowed vehicle trajectories for vehicle path planning. The method includes detecting objects in a predetermined vicinity around the ego-vehicle, and determining the relative velocity or other measure between each detected object and the ego-vehicle. The method defines a virtual dynamic safety shield around each detected object that has a shape, size and orientation that is determined by predetermined properties related to the current state of traffic around the ego-vehicle. The method also defines an action grid around the ego-vehicle. The method assesses the threat level of a potential collision between each detected object based on how the shield for that object and the action grid interact. The interaction between the shields and the grid induces actions aimed at aborting collisions and allows for trajectory planning.

20 Claims, 3 Drawing Sheets

DYNAMIC SAFETY SHIELDS FOR SITUATION ASSESSMENT AND DECISION MAKING IN COLLISION AVOIDANCE TASKS

BACKGROUND OF THE INVENTION

1. Field of the Invention

This invention relates generally to a system and method for assessing the potential for a collision in a vehicle collision avoidance system and/or to plan safety-allowed vehicle trajectories for vehicle path planning and, more particularly, to a system and method for assessing the potential for a collision in a vehicle collision avoidance system and/or to plan safety-allowed vehicle trajectories for vehicle path planning that employs holistic techniques including defining virtual dynamic safety shields around objects in the vicinity of an ego-vehicle and determining whether any of those shields interact with an action grid defined around the ego-vehicle.

2. Discussion of the Related Art

Vehicles are becoming more autonomous or cognitive with the goal being a completely autonomously driven vehicle, i.e., vehicles that are able to provide driving control with minimal or no driver intervention. Adaptive cruise control systems have been available for a number of years where not only does the system maintain a set speed, but also will automatically slow the vehicle down in the event that a slower moving vehicle is detected in front of the subject vehicle. Vehicle control systems currently exist that include autonomous parking where the vehicle will automatically provide the steering control for parking the vehicle. Also, control systems exist that may intervene if the driver makes harsh steering changes that may affect vehicle stability and lane centering capabilities, where the vehicle system attempts to maintain the vehicle near the center of the travel lane. Future vehicles will likely employ autonomous systems for lane changing, passing, turns away from traffic, turns into traffic, merging into traffic, passing through or turning at intersections, etc. As these systems become more prevalent in vehicle technology, it will be necessary to determine what the driver's role will be in combination with these systems for controlling vehicle speed, steering and overriding the autonomous system.

As vehicle technology trends towards more cognitive vehicles those vehicles are becoming better equipped with algorithms and intelligence that allows the vehicle to perform many safety and convenience functions. As sensors and algorithms advance, the amount of data that is available to be processed increases, and algorithms can be devised to use current data and historical data to make decisions concerning safe maneuvers in pre-planned trajectories and vehicle collision avoidance. The ultimate goal for such cognitive vehicles would be a vehicle that is capable of operation and decision making as if it were being driven by a human.

Part of the technology required for vehicle driver autonomy is the ability for vehicles to communicate with each other. Vehicular ad-hoc network (VANET) based active safety and driver assistance systems, such as a dedicated short range communications (DSRC) system, known to those skilled in the art, allow a vehicle to transmit messages to other vehicles in a particular area with warning messages about dangerous road conditions, driving events, accidents, etc. In these systems, either direct broadcast communications or multi-hop geocast routing protocols, known to those skilled in the art, are commonly used to communicate warning messages, i.e., to deliver messages to vehicles that are within direct communication range or are located within a few kilometers from the road condition. In other words, an initial message advising drivers of a potential hazardous condition is transmitted from vehicle to vehicle either in a direct broadcast fashion or by using a geocast routing protocol so that vehicles within the desired application range will receive the messages of interest.

The communications systems referred to above include vehicle-to-vehicle (V2V) and vehicle-to-infrastructure (V2I) applications that require a minimum of one entity to send information to another entity. For example, many vehicle-to-vehicle safety applications can be executed on one vehicle by simply receiving broadcast messages from one or more neighboring vehicles. These messages are not directed to any specific vehicle, but are meant to be shared with a vehicle population to support the safety application. In these types of applications where collision avoidance is desirable, as two or more vehicles talk to one another and a collision becomes probable, the vehicle systems can warn the vehicle drivers, or possibly take action for the driver, such as applying the brakes. Likewise, roadway infrastructure components, such as traffic control units, can observe the information broadcasts or otherwise sense vehicle traffic and provide a driver warning if there is a detected hazard (e.g., if a vehicle is approaching a curve at an unsafe speed or there is a crossing vehicle that is violating a red traffic signal phase).

Vehicle driving control autonomy is only as good as the ability of sensors on the vehicle to reliably detect and track objects around the vehicle. Many modern vehicles include object detection sensors that are used to enable collision warning or avoidance and other active safety applications. The object detection sensors may use any of a number of sensing technologies, such as short range radar, cameras with image processing, laser or LiDAR, ultrasound, etc. The object detection sensors detect vehicles and other objects in the path of a subject vehicle, and the application software uses the object detection information to provide warnings or take actions as appropriate. In many vehicles, the object detection sensors are integrated directly into the front or other fascia of the vehicle.

Current vehicle lane sensing systems typically use vision systems to sense the vehicle travel lane and drive the vehicle in the lane-center. Many of these known lane sensing systems detect lane-markers on the road for various applications, such as lane departure warning (LDW), lane keeping (LK), lane centering (LC), etc., and have typically employed a single camera, either at the front or rear of the vehicle, to provide the images that are used to detect the lane-markers.

SUMMARY OF THE INVENTION

In accordance with the teachings of the present invention, a system and method provided on an ego-vehicle are disclosed for assessing potential threats and deciding on required actions to avoid collisions in a vehicle collision avoidance system, and/or to plan safety-allowed vehicle trajectories for vehicle path planning. The method includes detecting objects in a predetermined vicinity around the ego-vehicle, and determining the relative velocity or other measure between each detected object and the ego-vehicle. The method defines a virtual dynamic safety shield around each detected object that has a shape, size and orientation that is determined by predetermined properties related to the current state of traffic around the ego-vehicle. The method also defines an action grid around the ego-vehicle. The method assesses the threat level of a potential collision between each detected object based on how the shield for that object and the action grid interact. The interaction between the shields and the grid induces actions aimed at aborting collisions and allows for trajectory planning.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a system and method for providing threat assessment and actions to avoid collisions in a collision avoidance system, and to plan safety-allowed trajectories, is merely exemplary in nature, and is in no way intended to limit the invention or its applications or uses.

Figure 1:
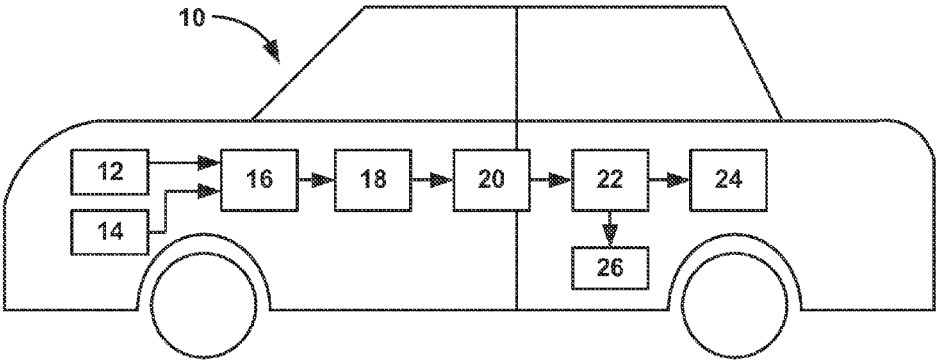
FIG. 1 is a simple illustration of a vehicle including a number of modules for assessing potential threats around the vehicle.

FIG. 1 is a simple illustration of a vehicle 10 that is equipped with an array of sensors, represented generally at box 12. The box 12 is intended to represent all of the sensors provided on the vehicle 10, including, but not limited to, cameras, LiDAR, radar, ultrasound, etc., in any suitable configuration, mix and match combination and position for a particular application consistent with the discussion herein. The vehicle 10 also includes a communications system 14, such as the DSRC system mentioned above, that allows the vehicle 10 to communicate with other similarly equipped vehicles around the vehicle 10. For example, other vehicles may broadcast information to be received by vehicles, such as obstacles in the road, position and speed data, etc. The data received by the sensors 12 and the communications signals received by the system 14 are provided to a sensory perception module 16 that processes the data and provides sensor data fusion, object detection, object tracking, etc. Those skilled in the art will readily recognize processors and algorithms that process data, images and information from various types of sensors and other signals and combine that information to detect and monitor objects both stationary and moving around the vehicle 10.

The processed information from the module 16 is provided to a situation assessment module 18 that uses the data to identify potential collision threats that may be around the vehicle 10 as it travels for collision avoidance and active safety purposes. It is noted that although collision avoidance is one of the abilities of the system discussed herein, other applications can also be provided such as vehicle path planning. For example, the system can be used to take necessary optimal actions when a potential threat is detected, and can also determine what vehicle routes to take and suggest alternative routes.

As will be discussed in detail below, the situation assessment module 18 provides holistic approaches and analysis for assessing the potential threats as the data concerning those threats is being continuously received and updated by the sensors 12 and/or the communications system 14. The assessed potential threat information from the situation assessment module 18 is sent to a behavior decision module 20 that uses the data concerning the movement and position of the potential threats around the vehicle 10 and the motion and position of the vehicle 10 to determine if corrections need to be made to the speed and direction of the vehicle 10 to avoid a potential collision. This information is sent to a motion planning module 22 that determines what those corrections to the speed and position of the vehicle 10 need to be for collision avoidance, and that control is implemented in a control module 24 to provide vehicle steering, throttle and/or braking control. The motion planning module 22 can also design short and long term trajectories to allow the vehicle 10 to safely arrive at predetermined destinations. The control module 24 may provide warnings and recommendations for the vehicle driver depending on the seriousness of the potential threat for a collision, such as on a display 26, or may automatically make speed and position changes of the vehicle 10 independent of the vehicle driver. Each of the modules 16, 18, 20, 22 and 24 will include the processors, algorithms and circuits necessary to perform the operation discussed herein.

Figure 2:
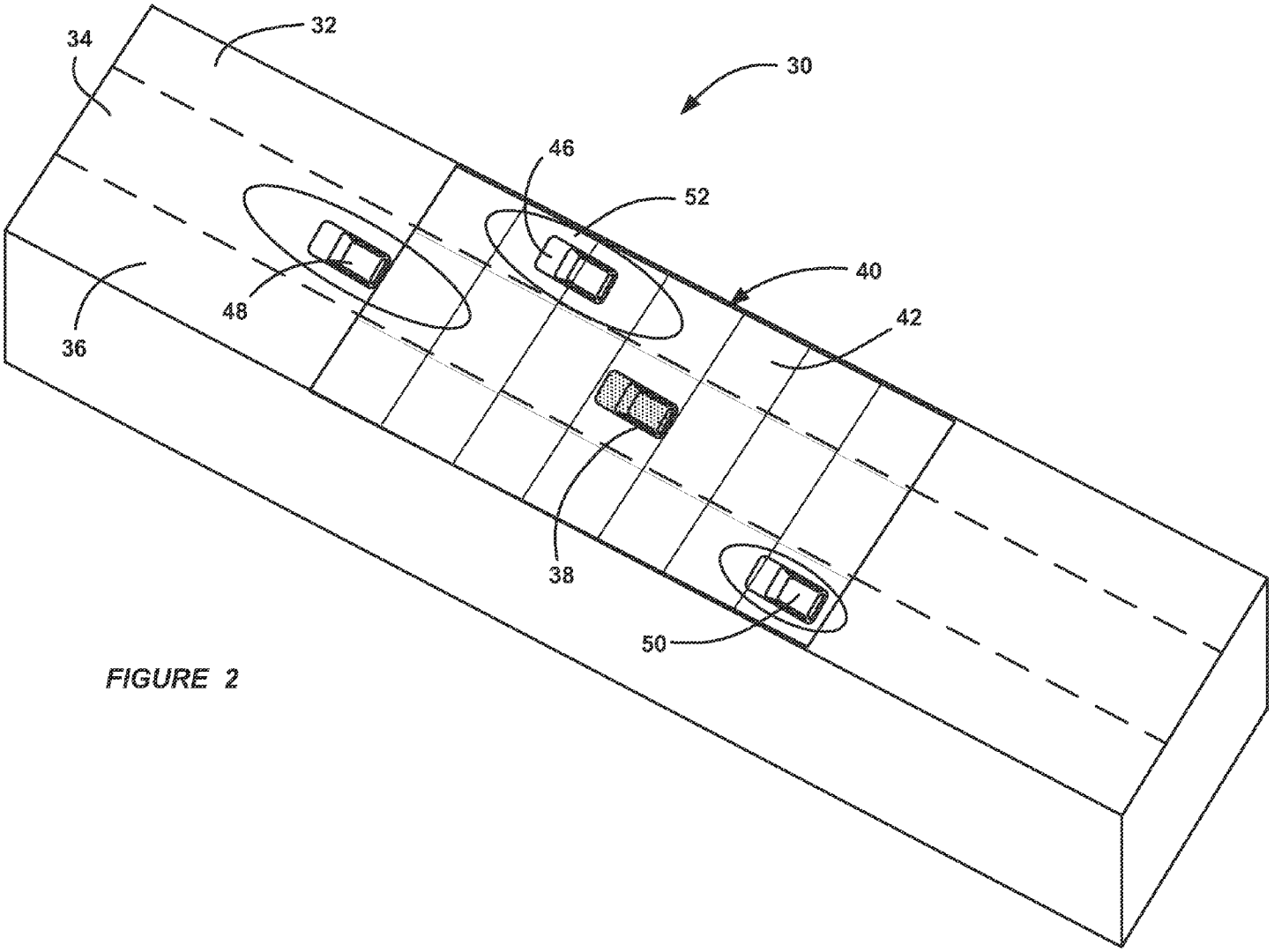
FIG. 2 is an illustration of a roadway showing an ego-vehicle surrounded by an action grid and other vehicles surrounded by dynamic safety shields.

FIG. 2 is an illustration of a roadway 30 including three travel lanes 32, 34 and 36. An ego-vehicle 38 is traveling within the center lane 34 and is the vehicle being discussed herein that is equipped with the modules and algorithms necessary to receive data concerning other objects in the vicinity of the vehicle 38, such as other vehicles, pedestrians, bicycles, objects, etc., both moving objects and stationary objects, that may pose a potential collision threat with the vehicle 38. As the ego-vehicle 38 moves and the other objects around the vehicle 38 move, there is a continuously and dynamically changing interaction between those objects.

The situation assessment module 18 assigns an action grid 40 around the ego-vehicle 38 that includes a number of individual cells 42. The size of the grid 40, the size of the cells 42, the number of the cells 42, the shape of the grid 40, etc. are all adaptable and application specific in that the grid 40 may change depending on the location of the vehicle 38, i.e., city driving, rural driving, congested driving, type of roadway, etc., the speed of the vehicle 38, the position of the vehicle 38, the type of the vehicle 38, etc. It is noted that the resolution of the grid 40 is adaptable, for example, each of the lanes 32, 34 and 36 may include three of the cells 42 to refer to the right, center and left positions in the particular lane. Further, the size and resolution of the grid 40 depends on the extent and detail to which the assessment and the trajectory planning is required or may be desired. In this non-limiting embodiment, the grid 40 has twenty-one of the cells 42 where three of the cells 42 extend across the entire roadway 30. In one embodiment, the size of the cells 42 in the grid 40 is set to a pre-fixed value. Within one sample time interval, the vehicle 38 may either remain in the center of the grid 40 (zero step) or make a transition to one of the neighboring cells 42 in the grid 40 (finite step) depending on the present threat level. The total transition of the vehicle 38 after one sample time interval is then obtained by the vector sum of the velocity of the vehicle 38 with respect to the roadway 30 and the additional (zero or finite) step taken on the grid 40 multiplied by the sample time interval. After each sample time interval, the center of the grid 40 is moved to the new position of the vehicle 38 to start a new threat assessment cycle.

Each static or dynamic object detected by the ego-vehicle 38 using the sensors 12 and/or the communications system 14 within a predetermined range will be assigned a virtual dynamic safety shield (DSS), where the DSS encodes information about the object as being a potential threat to the ego-vehicle 38. It is noted that the detection of an object and assigning a shield to that object is a holistic approach in that the type of object is not specifically identified, but only that the object exists and may pose a collision threat to the ego-vehicle 38. It is further noted, however, that if the type of object is known, then that information could be used to assess the threat, such as increase the shield size for a pedestrian. In this illustration, a vehicle 46 is traveling in the lane 32 ahead of the ego-vehicle 38, a vehicle 48 is traveling in the center lane 34 in front of the ego-vehicle 38, and a vehicle 50 is traveling in the lane 36 behind the ego-vehicle 38. Each of the vehicles 46, 48 and 50 is detected by the ego-vehicle 38 and is assigned a DSS 52. Further, a DSS 52 can be assigned to the ego-vehicle 38 to identify predetermined safety issues that may be related to general factors such as road or weather conditions.

In this embodiment, each DSS 52 is represented as an oval shape merely for illustration purposes. The shape, size and orientation of a particular DSS 52 depends on a predetermined measure between the detected object to which it has been assigned and the ego-vehicle 38. It is noted that the shape of the DSS 52 does not need to be symmetrical, and the particular object that is detected does not need to be positioned at the center of the DSS 52. The predetermined measure will likely be the relative velocity between the particular object and the ego-vehicle 38, although other measures, such as acceleration between the detected object and the ego-vehicle 38, distance between the detected object and the ego-vehicle 38, non-relative measures such as weather and road conditions, etc., may also be employed.

It is noted that the size of the DSS 52 may not only depend on the relative kinematics between the ego-vehicle 38 and the surrounding objects, but also on the absolute kinematics of the objects in the particular area. Moreover, the size of the DSS 52 may also resemble levels of understanding or measurement uncertainty. For example, if the sensory system is not certain about the detection or the kinematics of a suspicious object, a DSS of a larger size can be assigned to that object to suggest this uncertainty. Also, the size of the DSS 52 may be influenced by cues from traffic participants. For example, if it is apparent that a vehicle driving in an adjacent lane from the ego-vehicle 38 is intending to make a lane change, the system may change the size of the DSS 52 assigned to that vehicle to reflect this intent. Further, more than one measure may be used, where each measure may be assigned its own DSS where a particular detected object may include multiple shields. The size of the shield 52 can be chosen to encode a potential time (e.g. 2 s) to impact with the object. The size and resolution of the action grid 40 and the size of the shield 52 assigned to a particular object may also be a tunable parameter to allow the driver to selectively control the interaction of the ego-vehicle 38 with potential collision threats so as to be selective for different levels of driver aggressiveness. It is noted that this property is more related to weights that will be assigned to the grid cells 42, discussed below. Further, as mentioned, because detection of the objects is often not precise, the DSS 52 assigned to a particular object may also be encoded with an uncertainty factor that could be a weighted value based on a number of parameters, such as geographic location, weather, temperature, etc. Also, because the position of the shield 52 may change from one sample time to the next, a predicted pattern of the movement of the shield 52 can be anticipated to further enhance the decision making capability of a potential risk of collision with the object because of the ability to predict where the object will be in the future.

In one embodiment, as the relative velocity between a particular object and the ego-vehicle 38 increases so that the object and the vehicle 38 get closer together, the likelihood that the object will become a potential threat increases, and the size of the DSS 52 for that particular object should be increased. Because the detection of the objects and assignment of the safety shield to the object can be based on a relative measure between the ego-vehicle 38 and the object, and not based on other parameters in the roadway, a consistency of threat avoidance can be implemented if multiple vehicles traveling around each other all include the same implementation based on that notion of relative movement.

The action grid 42 around the ego-vehicle 38 interacts or convolutes with each DSS 52, where that interaction is assessed for collision avoidance in the assessment module 18. In this example, the DSS 52 for the vehicles 46, 48 and 50 overlap with the grid 40. The situation assessment module 18 on the ego-vehicle 38 may cause the behavior decision module 20 to initiate a vehicle action consistent with the discussion herein because of that interaction. In other words, if the DSS 52 assigned to a particular object enters the action grid 40, the situation assessment module 18 will identify that as a potential collision threat, which will cause the decision module 20 to calculate corrections, if necessary, to the vehicle position and velocity to avoid a collision. Because the size and shape of the shield 52 is determined by the relative position and velocity of both the object that the shield 52 has been assigned to and the ego-vehicle 38, the amount of interaction between the shield 52 and the action grid 40 sets the level of threat. For example, if a vehicle traveling in front of the ego-vehicle 38 suddenly decelerates, the relative position between that vehicle and the ego-vehicle 38 will quickly decrease and the relative velocity between that vehicle and the ego-vehicle 38 will quickly increase, which will cause the situation assessment module 18 to increase the size of the shield 52 around that vehicle, which will likely cause the shield 52 and the action grid 40 to interact resulting in some action being taken to avoid a collision with the vehicle, such as deceleration or lane changing.

Figure 3:
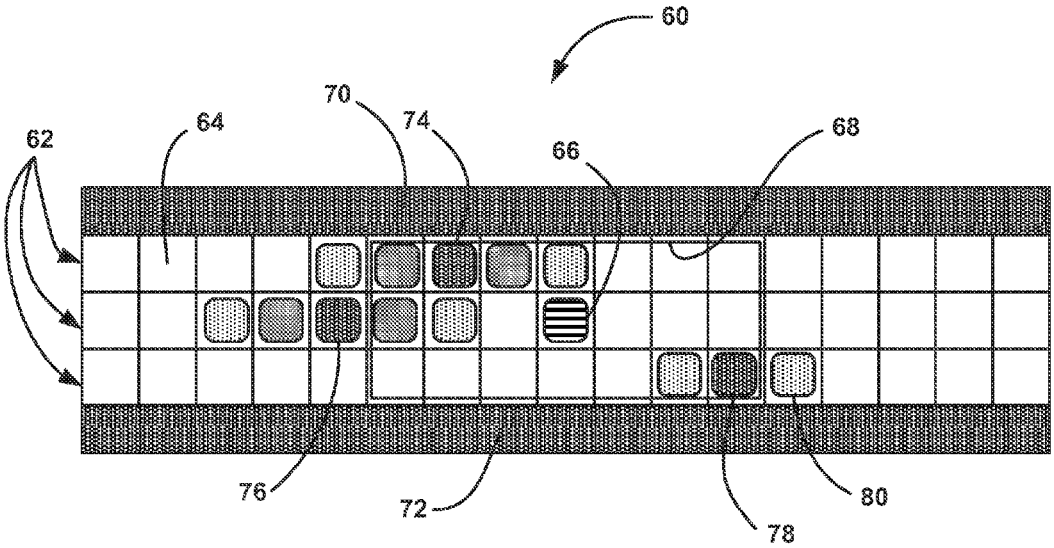
FIG. 3 is a discretized grid of a portion of the roadway shown in FIG. 2 illustrating situation assessment and potential threats.

In one embodiment, the situation assessment module 18 discretizes the action grid 40 and the safety shields 52 in an internal grid model to assess the potential collision threats. FIG. 3 is an illustration of such an internal grid model 60. In the model 60, the lanes 32, 34 and 36 are represented by a row 62 of cells 64. The ego-vehicle 38 is represented by box 66 and the action grid 40 is represented by boundary 68 covering seven of the cells 64 along the direction of travel of the vehicle 38 and three of the cells 64 in the transverse direction across the lanes 32, 34 and 36, where the box 66 is at the center of the boundary 68. Areas 70 and 72 in the model 60 represent being off of the roadway, and are shaded dark to represent a high threat level of the vehicle 38 going off the road. The position of the vehicles 46, 48 and 50 at a certain point in time are illustrated by boxes 74, 76 and 78, respectively, and are also shaded dark indicating the threat level of the ego-vehicle 38 being in the same cell 64 as one of the vehicles 46, 48 and 50. The DSS 52 around each of the vehicles 46, 48 and 50 is represented by a number of boxes 80 having different shades of darkness where the boxes becomes darker the closer the particular box 80 is to the box representing the actual vehicle.

The action grid 40 in FIG. 2 and the boundary 68 in FIG. 3 are identified for the situation assessment as discussed above. They are also used to provide decisions by the behavior decision module 20 and to perform motion planning in the module 22 based on the risk assessment that has been determined. When the behavior decision module 20 determines that a certain action should be taken, the motion planning module 22 can then determine how the ego-vehicle 38 will be moved from cell to cell. Any suitable technique can be used to generate the actions determined by the decision module 20. Non-limiting examples include employing cellular automata or optimization principles, both well known to those skilled in the art. It is noted that actions are subjected to the kinematical and dynamical limitations of the ego-vehicle 38 which bound the achievable vehicle lateral acceleration depending on the longitudinal velocity and dynamic stability. Other limitations may stem from the road shape, local traffic rules, etc.

Figure 4:
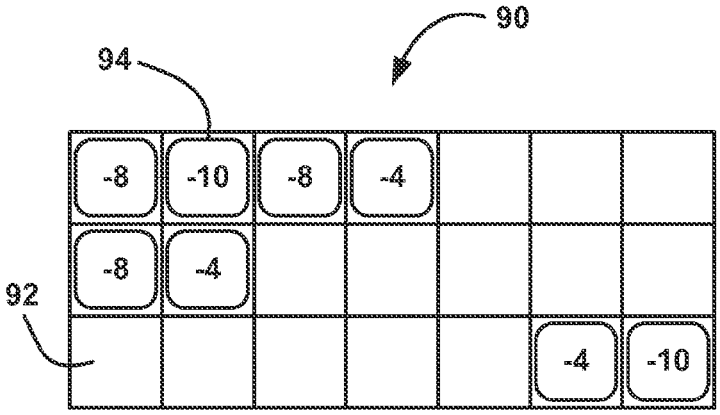
FIG. 4 is an illustration of the grid shown in FIG. 3 including road weights.

In the optimization approach for motion planning, each of the cells 64 is assigned a weight where the more negative the weight, the higher a cost function is for the ego-vehicle 38 to be in that cell at that particular point in time. In a probabilistic framework, the negative weight implies that it is less likely to make a transition to that cell. FIG. 4 is an illustration of a grid 90 showing cells 92 representing each of the cells 64 in the boundary 68. Road weights that express threats are given to each of the cells 92 based on the portion of a safety shield that may exist in those cells. Particularly, a number of boxes 94 are shown within some of the cells 92 where each box 94 depicts one of the boxes 80 in the boundary 68. Those cells 92 that do not include a box 94 do not have a shield in that discretized portion of the grid. Each of the boxes 94 illustrated in the grid 90 includes a number value that identifies the threat cost function that is identified for the ego-vehicle 38 to be in that particular cell. The highest negative values in the boxes 94 represent the darkest shaded boxes 76 and the perceived exact location of the object in that shield, and thus, represent the highest threat. It is noted that this is by way of a non-limiting example in that this may be an approximate position of the object. The value of the weight decreases (becomes less negative) within the shield 52 as the distance from the center of the shield 52 increases.

Figure 5:
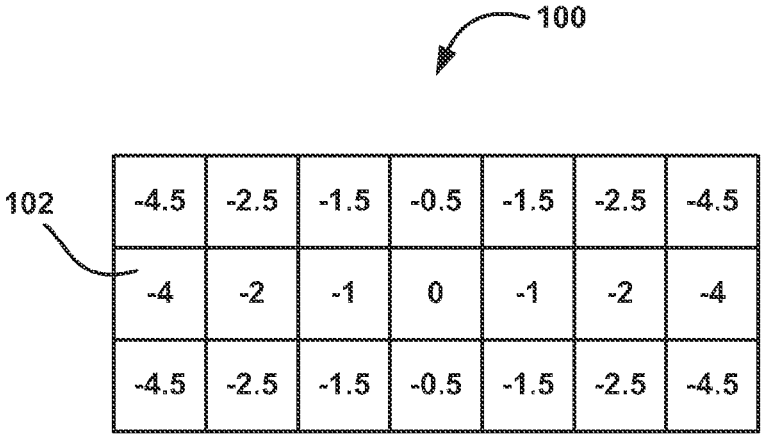
FIG. 5 is an illustration of the grid shown in FIG. 3 including action weights.

FIG. 5 is an illustration of a grid 100 also showing cells 102 representing each of the cells 64 in the boundary 68. Each of the cells 102 is assigned a weight value that reflects the cost to be paid for a potential action in the next time interval. That action will change the centered position of the ego-vehicle 38 at the subsequent sample time to another cell within the boundary 68 without regard for other objects that may be detected. In a probabilistic framework the action weights are equivalent to transition probabilities for the ego-vehicle 38 to move from the center of the cell to all other cells. As depicted, the center cell of the grid 100 where the ego-vehicle 38 is located is assigned a zero cost function meaning that the safest place for the ego-vehicle 38 to be is in that cell. The center cell represents the natural and optimal position for the ego-vehicle 38 according to the current kinematics of the ego-vehicle 38, but regardless of the possible obstacles around the vehicle 38. The farther away the cell is from the center cell in the travel lane of the ego-vehicle 38, the cost function increases, i.e., becomes more negative, because it becomes generally less safe to make a transition within one time step into that cell, thus requiring large accelerations. Likewise, the farther away from the center cell in the adjacent lanes also increases the action weight. Switching lanes is also associated with an increased cost function.

Figure 6:
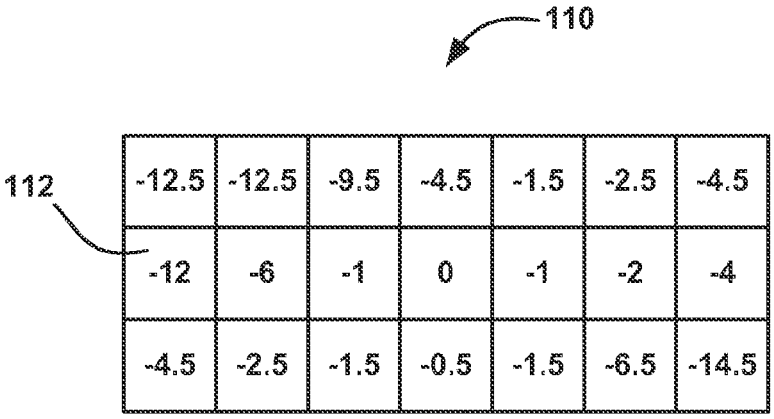
FIG. 6 is an illustration of the grid shown in FIG. 3 including combined road weights and action weights.

In the optimization approach, the road weights in the grid 90 are combined with the action weights in the grid 100 to provide a grid 110 shown in FIG. 6 from which the optimal position of the ego-vehicle 38 in the next time step can be determined. The grid 110 also shows cells 112 representing each of the cells 64 in the boundary 68. As is apparent, the optimal position weights are determined by adding the corresponding road weights and action weights from the grids 90 and 100, respectively, to assess the cost of the ego-vehicle 38 moving from the center cell to another cell in one sample time period. It is noted that the optimal position weights can be achieved by applying a weighted sum of the road weights and the action weights. The road weights and the action weights can be adapted in real time to reflect changes in the traffic conditions.

Alternately to the optimization approach, the behavior decision module 20 and the motion planning module 22 can be implemented using a cellular automaton. A cellular automaton uses the following inputs: (i) the states of the other vehicles that are located within the action grid 40, where the states may be relative position and relative speed of the center of mass, and (ii) the grid cells that are covered by the DSSs. The cellular automaton then applies a set of predefined rules to generate a new output state of the ego-vehicle 38. For example, the behavior decision module 20 may determine that the ego-vehicle 38 should always remain one cell from the DSS 52 of every object, and thus the ego-vehicle 38 will change its state accordingly in order to meet this goal.

As will be well understood by those skilled in the art, the several and various steps and processes discussed herein to describe the invention may be referring to operations performed by a computer, a processor or other electronic calculating device that manipulate and/or transform data using electrical phenomenon. Those computers and electronic devices may employ various volatile and/or non-volatile memories including non-transitory computer-readable medium with an executable program stored thereon including various code or executable instructions able to be performed by the computer or processor, where the memory and/or computer-readable medium may include all forms and types of memory and other computer-readable media.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A method for identifying potential threats, said method comprising:

providing one or more computer modules programmed for:

detecting a plurality of objects in a predetermined vicinity around an ego-vehicle using one or more sensors, a vehicle communications system, or a combination thereof;

determining a predetermined measure between each detected object and the ego-vehicle;

defining a virtual dynamic safety shield around each detected object having a size determined by the measure between the object and the ego-vehicle, wherein defining the safety shield includes assigning an uncertainty factor to the safety shield that defines an uncertainty about a location of the object;

defining an action grid around the ego-vehicle;

assessing a potential interaction between each detected object and the ego-vehicle based on whether and how much the shield for that object and the action grid overlap; and using a control module to control vehicle steering, throttle control, braking control, a driver warning, or a combination thereof if a predetermined potential threat value has been achieved.

2. The method according to claim 1 wherein detecting a plurality of objects includes employing a plurality of sensors on the ego-vehicle.

3. The method according to claim 1 wherein detecting a plurality of objects includes employing communications signals between the ego-vehicle and the objects.

4. The method according to claim 1 wherein determining a predetermined measure includes determining a relative velocity between each detected object and the ego-vehicle.

5. The method according to claim 1 wherein determining a predetermined measure includes determining a relative acceleration between each detected object and the ego-vehicle.

6. The method according to claim 1 wherein determining a predetermined measure includes determining a relative distance between each detected object and the ego-vehicle.

7. The method according to claim 1 wherein defining the safety shield includes tuning the safety shield based on an ego-vehicle's driver aggressiveness such that the driver of the ego-vehicle selects a size of the safety shield.

8. The method according to claim 1 wherein defining the safety shield includes anticipating a position of each detected object in the future based on where the object has been in the past and increasing the size of the safety shield for a particular object if the potential threat for the particular object increases.

9. The method according to claim 1 wherein defining an action grid includes defining an action grid having a predetermined number and size of cells.

10. The method according to claim 1 wherein assessing a threat level includes discretizing the safety shields and the action grid.

11. The method according to claim 10 further comprising assigning road weights to each discrete element in the action grid that identifies a relative velocity between the object and the ego-vehicle.

12. The method according to claim 11 further comprising assigning an action weight to each discrete element in the action grid that identifies a cost function for the ego-vehicle to move from its next expected location.

13. The method according to claim 12 further comprising providing a weighted sum between the road weights and action weights to identify a total cost function for each discrete element in the action grid.

14. The method according to claim 1 wherein defining the safety shield includes increasing the safety shield if the object is at least one of a pedestrian, road condition or weather conditions.

15. A method for identifying potential threats in a vehicle collision avoidance system provided on an ego-vehicle, said method comprising:

providing at least one computer module that is programmed for:

detecting at least one object in a predetermined vicinity around the ego-vehicle using a plurality of sensors;

determining a relative kinematic between the detected object and the ego-vehicle;

defining a virtual dynamic safety shield around the detected object that has a size determined by the relative kinematic between the object and the ego-vehicle where the size of the dynamic safety shield increases as the relative kinematic increases, wherein defining the safety shield includes assigning an uncertainty factor to the safety shield that defines an uncertainty about a location of the object;

defining an action grid around the ego-vehicle, said action grid including a plurality of cells;

assessing the threat level of a potential collision with the detected object based on whether the shield for the object and the action grid overlap; and using a control module to control vehicle steering, throttle control, braking control, a driver warning, or a combination thereof if a predetermined potential threat value has been achieved.

16. The method according to claim 15 wherein the at least one object is a stationary object or a moving object.

17. The method according to claim 15 wherein defining the safety shield includes anticipating a position of each detected object in the future based on where the object has been in the past and increasing the size of the safety shield for a particular object if the potential threat for the particular object increases.

18. The method according to claim 15 wherein assessing the threat level includes discretizing the safety shields and the action grid.

19. The method according to claim 15 wherein the relative kinematic is velocity.

20. The method according to claim 15 wherein defining the safety shield includes increasing the safety shield if the object is at least one of a pedestrian, road condition or weather conditions.

* * * * *